United States Patent [19]

Hargenrader et al.

[11] Patent Number: 4,503,917

[45] Date of Patent: Mar. 12, 1985

[54] CARRIAGE FEED SYSTEM

[75] Inventors: Richard J. Hargenrader, Orrville; James A. Miller, Strasburg, both of Ohio

[73] Assignee: Ingersoll-Rand Company, Woodcliff Lake, N.J.

[21] Appl. No.: 434,892

[22] Filed: Oct. 18, 1982

[51] Int. Cl.[3] ..... E21B 15/00; E21C 5/06

[52] U.S. Cl. ..... 173/147; 173/152

[58] Field of Search ..... 173/147, 22, 23, 85, 173/86, 152, 151, 164; 175/122, 162

[56] References Cited

U.S. PATENT DOCUMENTS

| | | | |
|---|---|---|---|
| 2,812,163 | 11/1957 | Wolfram | 173/147 |
| 2,976,942 | 3/1961 | Pitcher | 173/147 |
| 3,149,540 | 9/1964 | Lindgren et al. | 173/147 |
| 3,288,229 | 11/1966 | Chappuis | 173/147 |
| 3,535,985 | 10/1970 | Attebo | 173/147 |
| 3,642,075 | 2/1972 | Wills | 173/147 |
| 3,659,655 | 5/1972 | Gyongyosi | 173/1 |
| 3,692,123 | 9/1972 | Gyongyosi | 173/147 |
| 3,835,940 | 9/1974 | Winter, Jr. | 173/147 |
| 3,867,989 | 2/1975 | Hisey et al. | 173/147 |
| 3,986,564 | 10/1976 | Bender | 173/151 |
| 4,258,796 | 3/1981 | Horning et al. | 173/164 |

*Primary Examiner*—Frank T. Yost
*Assistant Examiner*—Hien H. Phan
*Attorney, Agent, or Firm*—R. J. Falkowski

[57] ABSTRACT

An improved drill feeding mechanism for a rock and earth drilling machine is disclosed wherein substantially all the loading forces due to the drilling and extracting operations are directed away from the upper portion of the tower. This is accomplished in the preferred embodiment by having a hydraulically displaced carriage guidingly supported for linear translation along a drill tower. Cable reeving about the carriage is anchored at a mid point on the tower and reversably displaces a guided drilling head at twice the linear velocity of the carriage and in the same direction. A hydraulic cylinder is attached at the tower base and activates the carriage.

10 Claims, 4 Drawing Figures

CARRIAGE FEED SYSTEM

DESCRIPTION

Background of the Invention

This invention relates to drill feeding mechanisms for drilling machines that are utilized for drilling holes in earth and rock that are used in such applications as water wells, shallow oil and gas bores, blast holes, and exploration drilling. It is common practice, in such machines, to fully support the loading resulting from the drilling and extracting operations by the top of the derrick or tower. Such loading is induced at the top of the towers through forces generated by a hydraulic cylinder, transmitted through a cable or chain arrangement over sheaves or sprockets that are attached to the top of the tower for directing the force to raise or lower the rotary drilling head. For a more detailed description of this type of construction see U.S. Pat. No. 3,659,655, issued to Gyongyosi on May 2, 1972. What is needed is an arrangement whereby loading forces are directed to the structure of the tower that is positioned well down from the top. The upper portion of the tower, not carrying any of the drill loading forces, would only provide lateral guidance for the drill feeding mechanism.

It is therefore an object of this invention to provide a drill feeding mechanism in a rock or earth drilling machine having a support tower, the upper portion of which is free from all loading forces resulting from the drilling and extracting operations.

It is another object of this invention to provide a drill feeding mechanism and tower arrangement whereby the only operating forces acting on the upper portion of the tower are those forces necessary to guide the drill feeding mechanism during the drilling and extracting operation.

SUMMARY OF THE INVENTION

According to the present invention, there is provided a drilling machine for drilling holes in earth and rock. The machine includes a tower, a drilling head, a means for guiding the drilling head for vertical movement along a predefined path with respect to the tower, and a drill means attached to the drilling head for drilling holes. A feed means for effecting the vertical movement of the drilling head is provided comprising a carriage means having upper and lower wheels journaled therein for rotation and at least one flexible segment joined to form a continuous unitary loop disposed about a portion of each of the upper and lower wheels and in guided engagement therewith. An anchor means is provided for rendering a first portion of the flexible segment stationary and immovable with respect to the tower. A coupling means is further provided for attaching a second portion of the flexible segment to the drilling head. An actuator means is arranged for imparting motion to the carriage means whereby the continuous unitary loop tracks about the periphery of the upper and lower wheels thereby imparting vertical movement to the drilling head along the predefined path.

DESCRIPTION OF THE DRAWINGS

Other objects, features, and advantages will become more apparent upon reading the following detailed description in conjunction with the accompanying drawings in which.

DESCRIPTION OF THE PREFERRED EMBODIMENT

Figure 1:
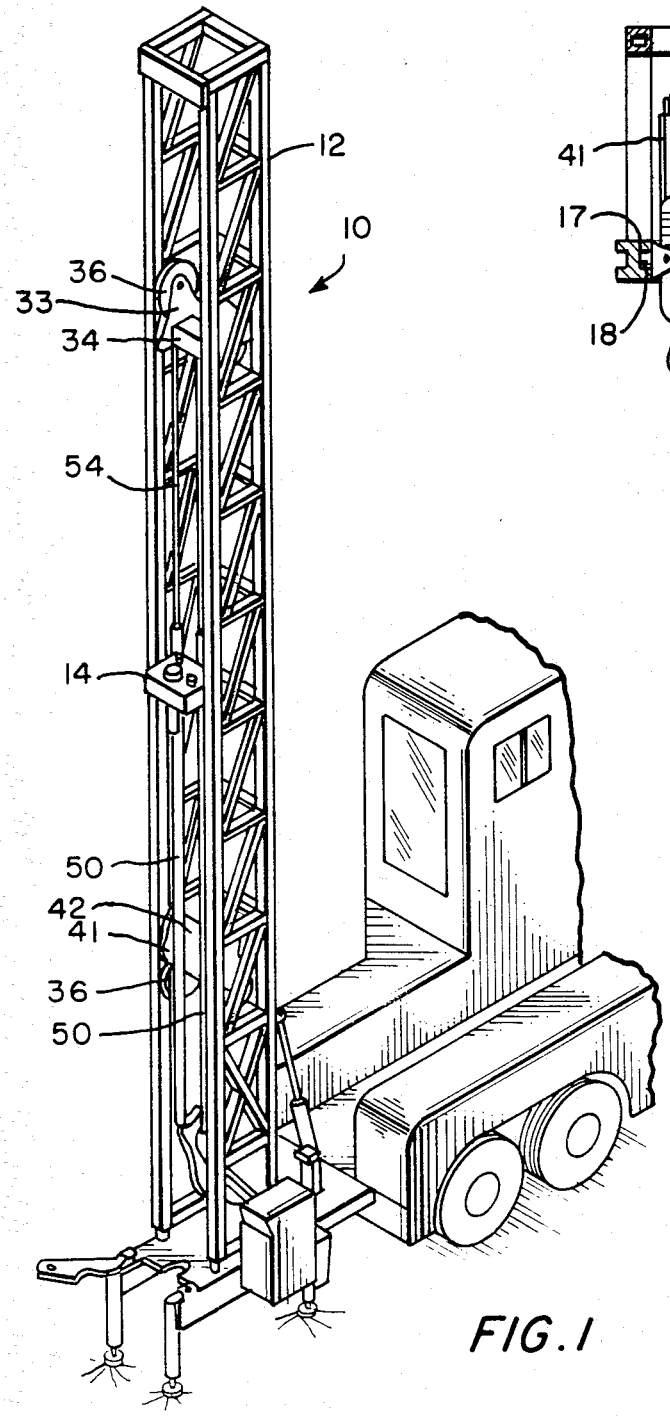
FIG. 1 is a partial perspective view of a rock and earth drilling machine showing a preferred embodiment of this invention.
Figure 4:
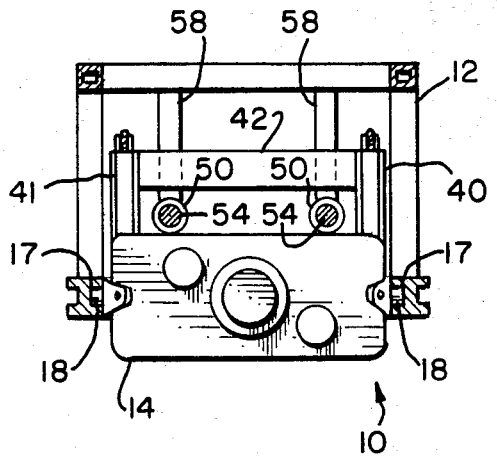
FIG. 4 is a section view taken along the lines 4—4 in FIG. 2.

Referring to FIGS. 1, 2, 3 and 4 there is shown a drilling machine 10 having a conventional tower or derrick 12, a drilling head 14, and a conventional drill string 16 coupled to the drilling head 14 for drilling holes in rock and earth. A pair of substantially vertical tracks 17 associated with the tower engage a pair of guide rollers or blocks 18 attached to the drilling head. The rollers or blocks 18 guide the drilling head, constraining its movement to movement along a predefined path that is parallel to the desired bore axis. That is, along a path parallel to the axis of the hole being drilled. The tracks 17 and guide blocks 18 further cooperate to prevent rotation of the drilling head 14 due to torque resulting from the drilling operation. A conventional power source, not shown, provides the necessary power to drive the drilling head 14.

Figure 2:
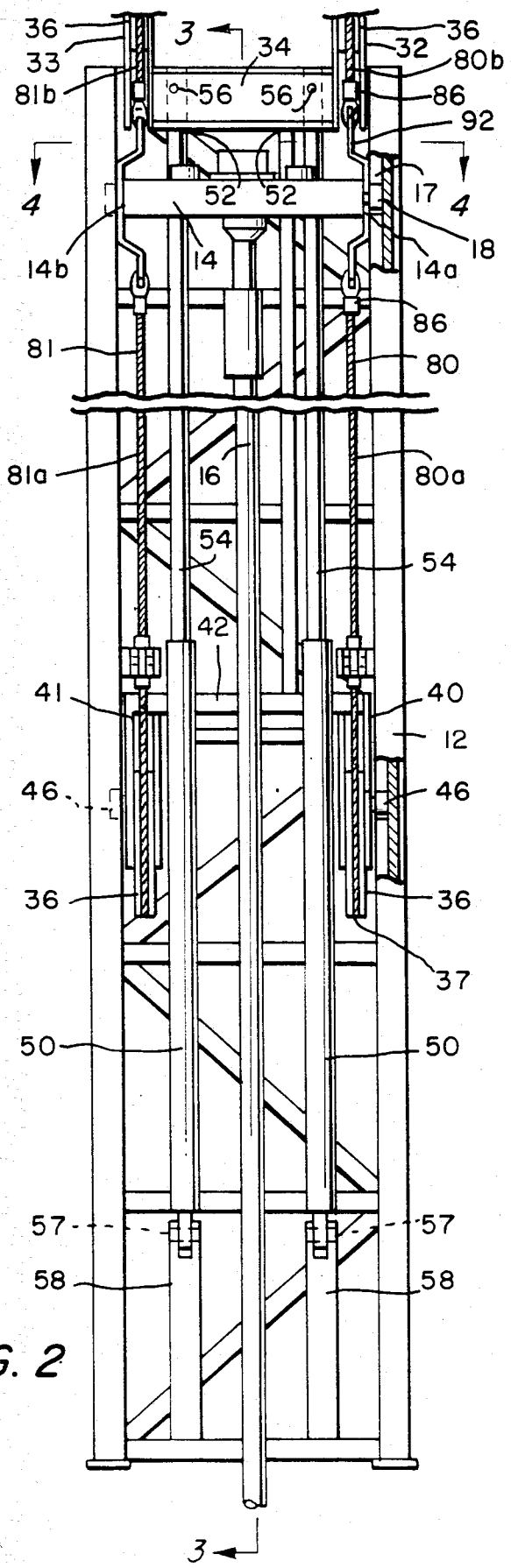
FIG. 2 is a front view of the mechanism shown in FIG. 1.
Figure 3:
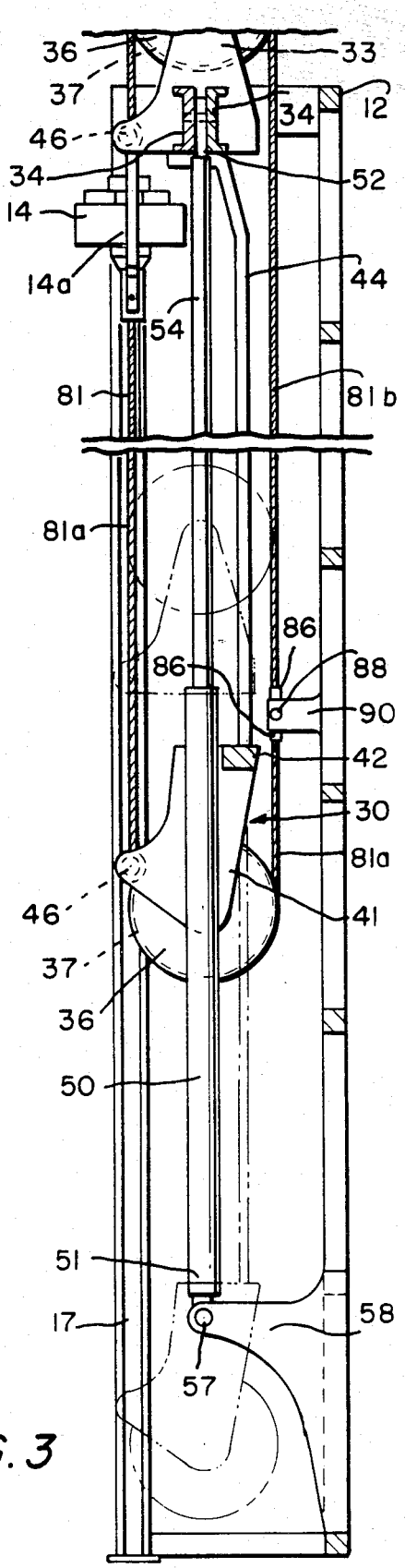
FIG. 3 is a side view of the drill feeding mechanism taken along lines 3—3 in FIG. 2.

A feed carriage 30 is arranged within the interior of the tower 12 for longitudinal movement with respect thereto. The carriage 30 includes a pair of upper U-shaped members 32 and 33 rigidly interconnected by a pair of structural channel members 34. Each U-shaped member 32 and 33 has a wheel or sheave 36 journaled therein for rotation and is arranged so that the two free ends of the U-shaped member straddle the sheave as shown in FIGS. 2 and 3. The periphery of each of the sheaves 36 has a circumferential groove or guiding means 37 formed therein for tracking engagement with a rope, steel cable, or other flexible segment. Similarly, the carriage 30 further includes a pair of lower U-shaped members 40 and 41 rigidly interconnected by a structural member 42, each member 40 and 41 having a sheave 36 journaled therein for rotation similar to the members 32 and 33. A pair of extension bars 44 having suitable cross bracing form the frame of the carriage 30 and rigidly interconnect the channel members 34 and the structural members 42. The U-shaped members 32 and 40 are arranged so that their respective sheaves are coplanar. Similarly, the U-shaped members 33 and 41 are arranged so that their respective sheaves are coplanar. Each U-shaped member 32, 33, 40 and 41 has associated therewith a roller or guide member 46 which engages one of the pair of tracks 17 so that the carriage 30 is constrained to movement that is parallel to that of the drilling head 14. The carriage 30 is thereby held captive within the structure of the tower 12 yet is free to move in conjunction with the drilling head 14 along a predefined path that is parallel to the bore axis.

Movement of the carriage 30 is effected by a pair of actuators or hydraulic cylinders 50. The free ends 52 of the piston rods 54 are attached to the channel members 34 by suitable pin fasteners 56. The cylinder ends 51 are similarly attached, by suitable pin fasteners 57, to a pair of mounting brackets 58 that are formed integral to the tower 12 structure, as shown in FIG. 3.

A pair of flexible segments 80 and 81, such as rope, steel cable, chain, or the like, are disposed about the two pairs of coplanar sheaves (or sprockets as in the case of chain) 36 in tracking engagement therewith. Each of the flexible segments 80 and 81 comprise two subsegments 80*a*, 80*b*, and 81*a*, 81*b* of equal lengths. One end of the two subsegments 80*a* and 80*b* have eye terminals 86 attached with a suitable pin or screw fastener 88 to a boss or anchor means 90 that is rigidly attached to the tower 12. The other ends of the two subsegments 80*a* and 80*b* also have eye terminals 86 attached thereto which in turn are attached to opposite ends of a drilling head bracket or coupling means 92. The drilling head bracket 92 is rigidly attached to the side 14*a* of the drilling head 14 with suitable screw fasteners or weld. As described above the two subsegments 80*a* and 80*b* and the drilling head bracket 92 are joined to form a continuous unitary loop disposed about a portion of the periphery of the two sheaves 36 and in tracking engagement with the grooves 37 thereof. The segment 81 is similarly constructed and associated with a bracket 92 which is attached to the side 14*b* of the drilling head 14.

In operation, drilling would begin with the carriage 30 in the top most position as shown in solid lines in FIG. 3. Note that in this position a portion of the sheaves 36 and the upper U-shaped members 32 project above the top of the tower 12. The tower 12 need only be tall enough to maintain tracking engagement between the tracks 17 and the guide members or rollers 46. The hydraulic cylinder is pressurized and fully extended thereby maintaining the carriage 30 in this position against the combined weight of the carriage 30, the drilling head 14, and the drill string 16. The subsegment 80*b*, having a tensile load equal to the combined weight of the drilling head 14 and the drill string 16, transfers that load to the anchor 90 in the form of an upwardly directed force at the fastener 88. Neglecting the couple placed on the carriage 30, and other minor forces, the only other major force in the system is that induced through the fasteners 57 into the mounting brackets 58 which is approximately equal to two times the tensile loading of the subsegment 80*b* plus the weight of the carriage 30 and the actuators 50. With the carriage 30 in the top most position, the drilling head 14 is positioned relatively close to the undersides of the pair of U-shaped members 32, while the upper sides of the pair of U-shaped members 40 are positioned just below the anchor 90.

As the drilling operation begins the cylinder 50 is retracted in relation to the rate of drill feed that is desired. As the carriage 30 descends, the segments 80 and 81 track about the sheaves 36 journaled in the carriage 30 in a counterclockwise direction, as viewed in FIG. 3, thereby causing the drilling head 14 to also descend. The rate of descent of the drilling head, however, is twice that of the carriage 30 due to the geometry of the mechanism.

When the carriage 30 has reached its lowest position, as shown in phantom lines in FIG. 3, the drilling head 14 will be positioned just above the U-shaped members 40 and 41. At this point in the operation, the drilling head is raised to the top of the tower again and another length of drill pipe attached to the drill string in the conventional manner.

While no attempt is made here to analyze all of the loading forces applied to the structure of the drilling machine disclosed herein, it is appropriate to point out that there are two points on the tower 12 that receive substantial loading forces. These are the pair of bosses 90 where the fasteners 88 attach thereto and the pair of mounting brackets 58 where the fasteners 57 attach. The anchors 90, which are positioned approximately midway between the two extreme ends of the tower 12, will be subjected to a maximum load equal to the tensile load in the subsegment 80*b* when the feed mechanism is extracting a relatively long drill string after drilling is complete. The mounting brackets 58, on the other hand, will be subjected to a load equal to twice the tensile load in the subsegment 80*b*. However, since these brackets are positioned near the base of the tower 12, the tower can easily absorb and dissipate these forces. The upper portion of the tower 12, from the pair of anchors 90 up to the top most extremity, is substantially free of tensile and compressive forces due to the drilling operation. Therefore, the weight and cost of manufacturing the upper portion of the tower can be substantially reduced over that of similar prior art devices.

Accordingly, there has been described a novel feed mechanism for a rock and earth drilling machine having substantial benefits over prior art machines. It is understood that the above described embodiment is merely illustrative of the application of the principles of this invention. Upon reviewing the present disclosure, numerous other embodiments may be disclosed by those skilled in the art without departing from the spirit and scope of this invention, as defined by the appended claims.

We claim:

1. In a drilling machine for drilling holes in earth and rock having a tower, a drilling head, a first guide means for guiding said drilling head for vertical movement along a predefined path with respect to said tower, and drill means attached to said drilling head for drilling holes, feed means for effecting said vertical movement of said drilling head comprising:

a. carriage means arranged for partaking of motion substantially parallel to said predefined path;

b. an upper wheel and a lower wheel journaled for rotation in said carriage means, each wheel having a second guide means formed in the periphery thereof for engaging and guiding a flexible segment, said upper and lower wheels arranged so that their respective said second guide means are coplanar;

c. at least one flexible segment joined to form a continuous unitary loop disposed about a portion of the periphery of each of said upper and lower wheels and in guiding engagement with said second guide means thereof;

d. anchor means located approximately midway on said tower for rendering a first portion of said at least one flexible segment stationary and immovable with respect to said tower;

e. coupling means for attaching a second portion of said at least one flexible segment to said drilling head;

f. actuator means interposed between the bottom of said tower and said carriage means for (a) imparting said motion to said carriage means whereby said continuous unitary loop tracks about the periphery of said upper and lower wheels thereby forceably imparting said vertical movement in both directions along said predefined path to said drilling head, and (b) removing all drawdown and lifting forces from the top half of said tower.

2. The combination set forth in claim 1 wherein said said first guide means for guiding said drilling head include a first guideway means associated with said tower and a first tracking means associated with said drilling head for trackingly engaging said first guideway means and constraining said drilling head to said vertical movement along said predefined path.

3. The combination set forth in claim 2 wherein said tower includes a second guideway means and said carriage means comprises an elongated member having its longitudinal axis disposed parallel to said predefined path and second tracking means for trackingly engaging said second guideway means and constraining said carriage means to said motion parallel to said predefined path.

4. The combination set forth in claim 3 wherein said upper wheel and said lower wheel are pulley sheaves and said at least one flexible segment is a steel cable.

5. The combination set forth in claim 3 wherein said upper wheel and said lower wheel are sprockets and said at least one flexible segment is a steel chain.

6. The combination set forth in claim 3 wherein said anchor means comprises a boss rigidly attached to said tower, at least one eye teminal attached to said first portion of said at least one flexible segment, and a fastener means for attaching said eye terminal to said boss.

7. The combination set forth in claim 3 wherein said coupling means comprises a drilling head bracket rigidly attached to said drilling head, at least one eye terminal attached to said second portion of said at least one flexible segment, and a fastener means for attaching said eye terminal to said drilling head bracket.

8. The combination set forth in claim 3 wherein said actuator means comprises a hydraulic cylinder.

9. The combination set forth in claim 1 wherein said continuous unitary loop of said at least one flexible segment is under continuous tension during at least a portion of said vertical movement along said predefined path.

10. A drilling machine for drilling holes in earth and rock having a tower, a drilling head, a means for guiding said drilling head for vertical movement along a predefined path with respect to said tower, drill means attached to said drilling head for drilling holes, and carriage means arranged for partaking of motion substantially parallel to said predefined path, said carriage means comprising an upper U-shaped member having a sheave journaled therein for rotation, and an extension bar having one end rigidly attached to the lower U-shaped member and arranged so that said sheaves are coplanar and projecting outwardly of said extension bar, a flexible steel cable arranged in a continuous unitary loop and disposed about a portion of the periphery of each of said sheaves, anchor means for rigidly attaching a first portion of said steel cable to said tower at approximately the tower midpoint, coupling means for rigidly attaching a second portion of said steel cable to said drilling head, and a hydraulic cylinder disposed between the tower and base and said carriage means arranged to (a) impart said motion to said carriage means, whereby said steel cable tracks about the periphery of said sheaves thereby forceably imparting said vertical movement in both directions along said predefined path to said drilling head, and (b) remove all drawdown and lifting forces from the top half of said tower.

* * * * *